United States Patent [19]

Forney, Jr.

[11] 4,408,821

[45] Oct. 11, 1983

[54] CONNECTOR FOR SEMI-RIGID COAXIAL CABLE

[75] Inventor: Edgar W. Forney, Jr., Harrisburg, Pa.

[73] Assignee: AMP Incorporated, Harrisburg, Pa.

[21] Appl. No.: 308,760

[22] Filed: Oct. 5, 1981

Related U.S. Application Data

[63] Continuation-in-part of Ser. No. 222,188, Jan. 2, 1981, which is a continuation of Ser. No. 55,564, Jul. 9, 1979, abandoned.

[51] Int. Cl.[3] ..... H01R 11/08

[52] U.S. Cl. ..... 339/177 R; 339/276 T

[58] Field of Search ..... 339/89 C, 95 R, 97 C, 339/177 R, 177 E, 223 R, 223 S, 258 A, 258 P, 258 RR, 276 R, 276 T

[56] References Cited

U.S. PATENT DOCUMENTS

| | | | |
|---|---|---|---|
| 3,448,430 | 6/1969 | Kelly | 339/143 |
| 3,475,545 | 10/1969 | Stark et al. | 174/88 |
| 3,533,051 | 10/1970 | Ziegler, Jr. | 339/177 |
| 3,537,065 | 10/1970 | Winston | 339/177 |
| 3,544,705 | 12/1970 | Winston | 174/75 |
| 3,564,487 | 2/1971 | Upstone et al. | 339/258 |
| **3,744,007** | **7/1973** | **Harak** | **339/97 R** |
| 3,778,535 | 12/1973 | Forney, Jr. | 174/88 C |
| 3,836,700 | 9/1974 | Niemeyer | 174/89 |
| 3,879,102 | 4/1975 | Horak | 339/143 R |

FOREIGN PATENT DOCUMENTS

| | | | |
|---|---|---|---|
| 923144 | 2/1955 | Fed. Rep. of Germany | 339/97 R |
| 1117687 | 11/1961 | Fed. Rep. of Germany | . |
| 2234680 | 6/1974 | France | . |

*Primary Examiner*—Joseph H. McGlynn
*Attorney, Agent, or Firm*—Adrian J. LaRue

[57] ABSTRACT

An electrical connector is disclosed for terminating semi-rigid coaxial cable, and comprises a grip ring having a continuous rearward end with multiple spline fingers extending forwardly therefrom and grooves on its inner surface, and a bored tubular shell member having a contoured internal diameter to accept the cable and the grip ring and grooves extending along an outer part of the bore of the shell member. The cable is drawn through the grip ring and the shell member, and as the grip ring is press inserted into a rearward end of the shell member, the spline fingers resiliently deflect inwardly along the shell member contour, and embed into the outer semi-rigid cable sheath to establish electrical contact therewith and the grooved bore score the outside surface of the grip ring during its movement into engagement with the cable sheath which causes the grooves of the grip ring to score the cable sheath, thereby providing antitorque connection therebetween.

10 Claims, 6 Drawing Figures

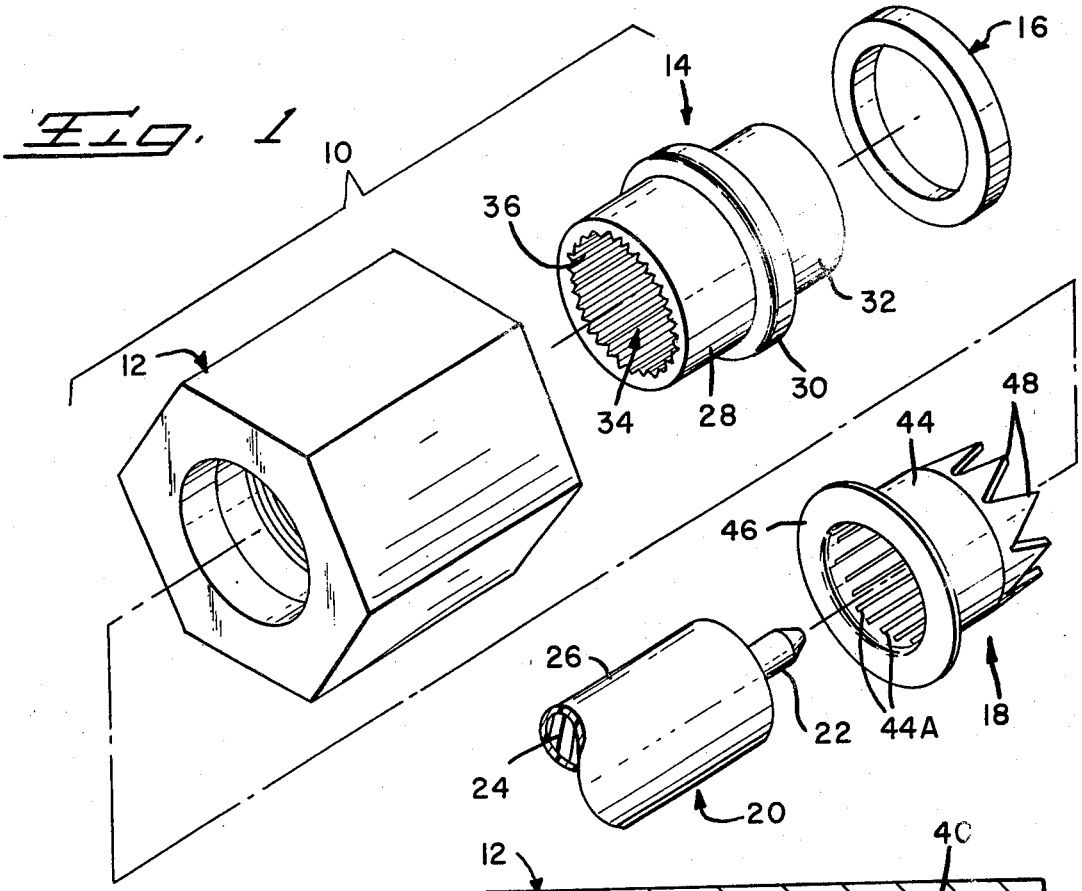
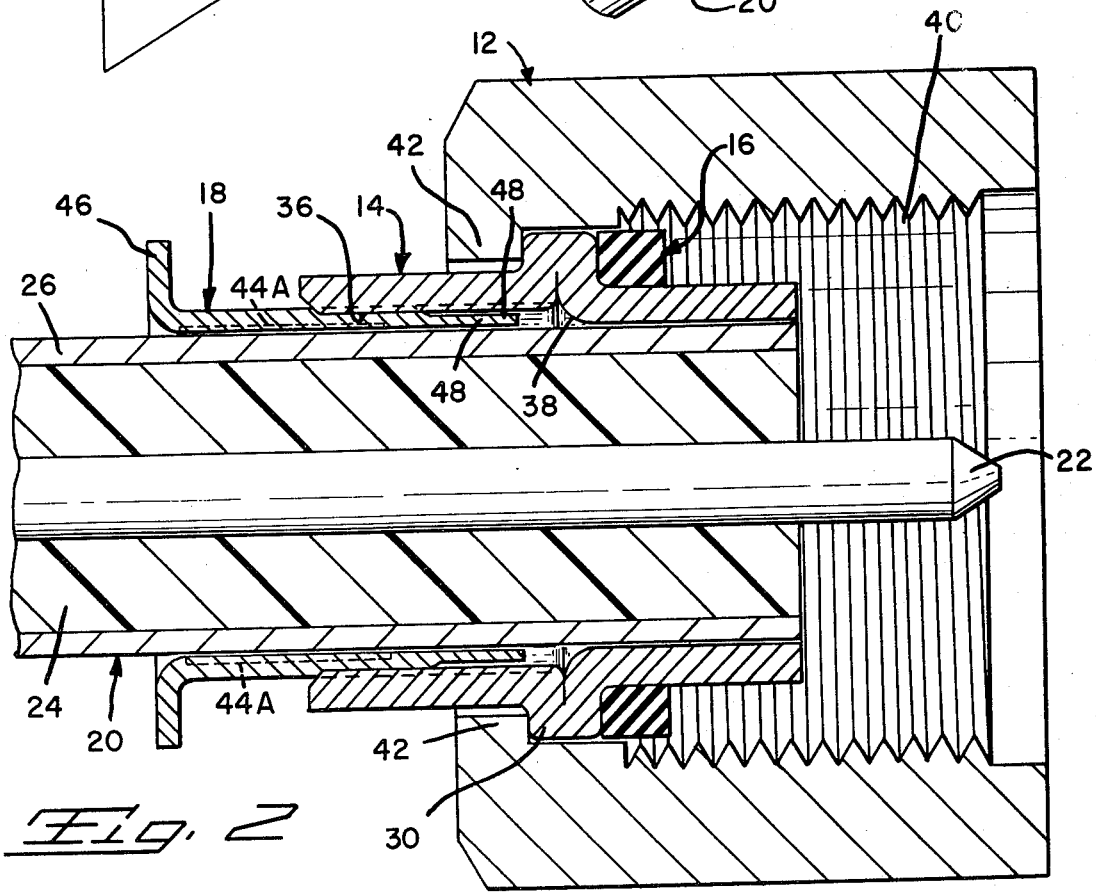
Fig. 2

Fig. 3A
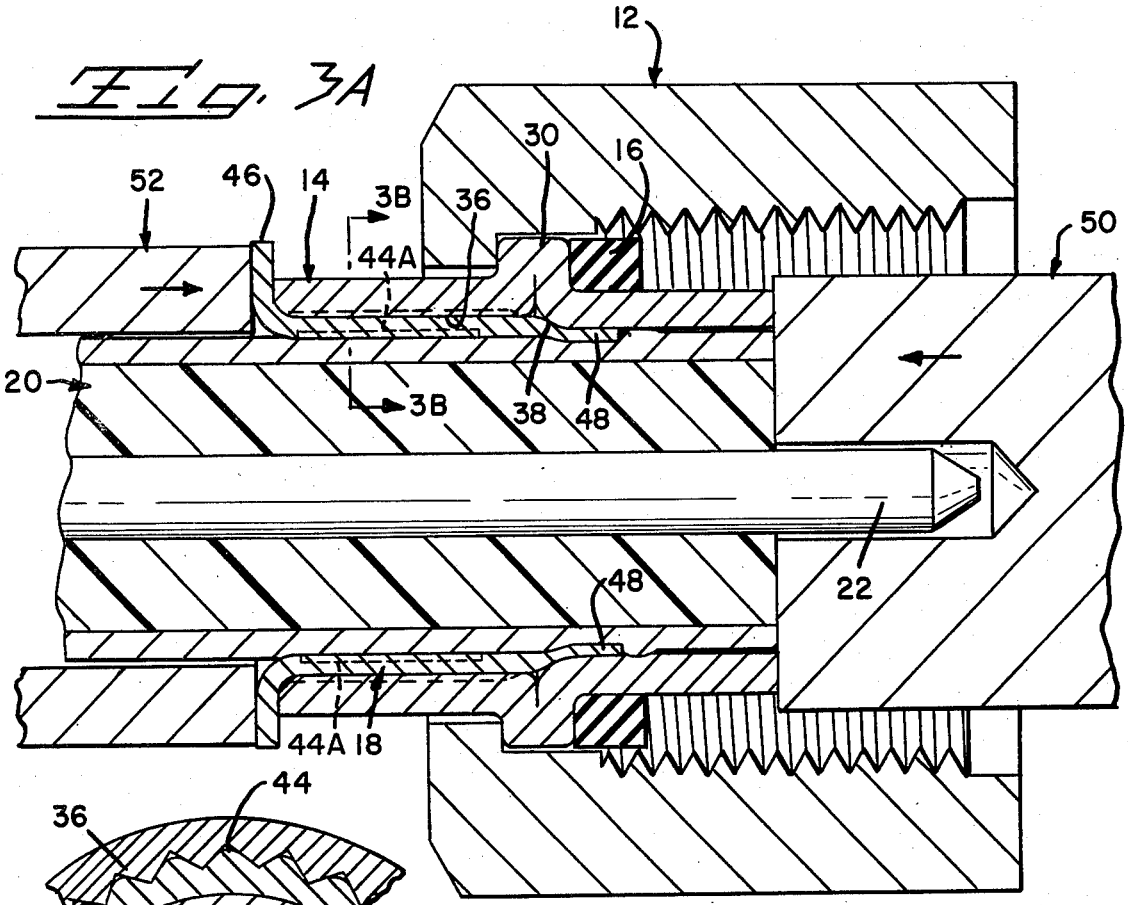
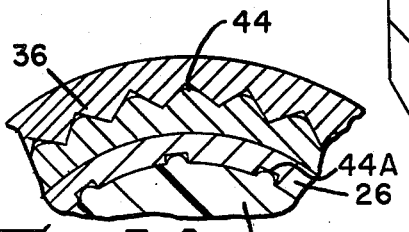
Fig. 3B
Fig. 4
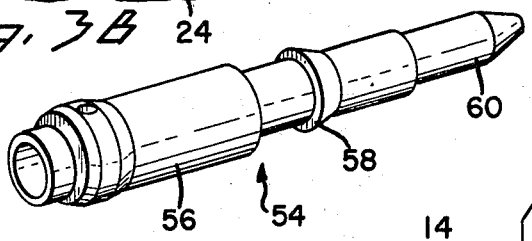
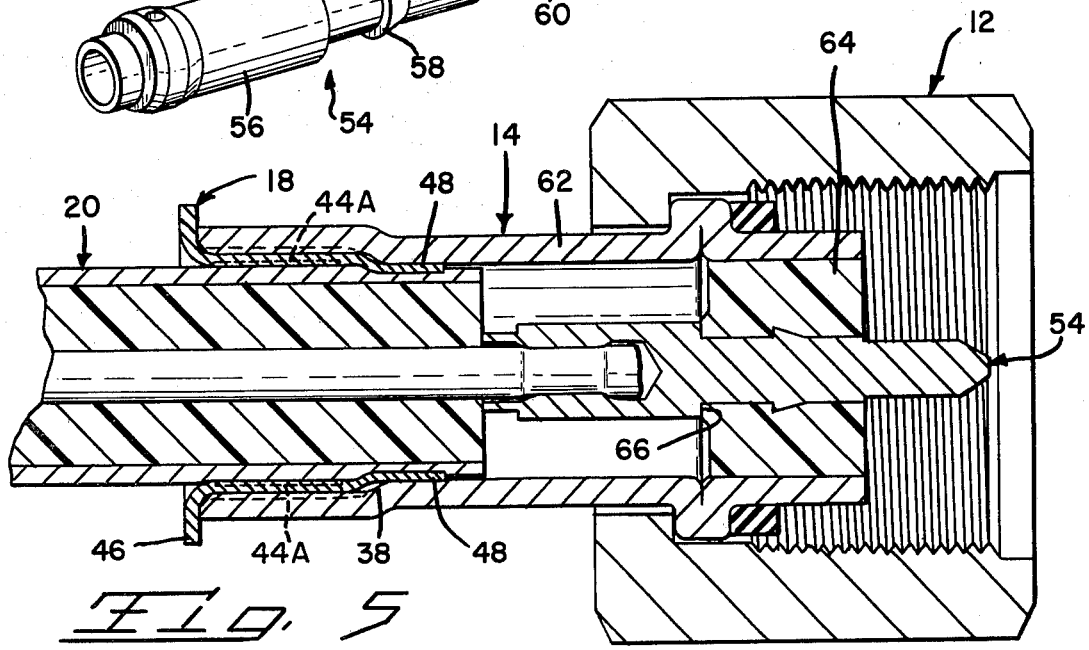
Fig. 5

CONNECTOR FOR SEMI-RIGID COAXIAL CABLE

This is a continuation-in-part of Ser. No. 222,188 filed Jan. 2, 1981 which is a continuation of Ser. No. 55,564, filed July 9, 1979, now abandoned.

BACKGROUND OF THE INVENTION

1. Field of the Invention

This invention relates to connector terminations for semi-rigid coaxial cable.

2. The Prior Art

The electrical industry utilizes semi-rigid coaxial cable in high performance RF applications. Use of such cables, however, has been limited because of the difficulty in achieving cable end termination. The solid, semi-rigid sheath of the coaxial cable, usually made of copper, makes it difficult to establish connectorized contact therewith without degrading electrical performance at the junction. While there are effective connectors available within the industry for this purpose, such connectors are generally expensive to produce, of multi-piece design, and employ costly labor intensive procedures to achieve cable end termination. One state-of-the-art procedure consists of pre-knurling the coaxial cable sheath, and subsequently crimping a copper connector sleeve thereto. While this approach achieves effective results, pre-knurling requires time, and inherently involves considerable variability due to sheath hardness variation, cable diameter variation, and metal build-up on the knurling tool. Another procedure for making connectorized contact with the outer cable sheath is by way of solder; however, soldering also entails shortcomings due to the excessive time required to effect a termination, and the inherent necessity of controlling the narrow temperature range required to effect a good joint to semi-rigid cable. Too low a temperature will form a weak "cold" solder joint; too high a temperature will cause excessive expansion and protrusion of the cable dielectric at the mating interfaces.

SUMMARY OF THE INVENTION

The present invention comprises a connector plug for terminating semi-rigid coaxial cable. The plug includes a grip ring having a solid continuous rearward end with grooves on its inside surface, and having multiple spline fingers extending forwardly therefrom; a tubular shell member having a bore of contoured internal diameter to accept the cable and the grip ring; external coupling means secured to the shell member; and forward gasket means for sealing the forward plug interface. The cable is drawn through the grip ring and the shell member, and as the grip ring is press inserted into a rearward end of the bored shell member, the spline fingers resiliently deflect inwardly along the contour of the shell bore to embed into the outer semi-rigid sheath of the cable. Internal longitudinal grooves are integrally provided within the inside surface of the rearward portion of the shell member which embed into the solid area of the grip ring and the grooves of the grip ring score the cable sheath to resist relative rotational motion between the grip ring and the shell member.

Accordingly, it is an object of the present invention to provide a connector for achieving consistent mechanical and electrical termination of semi-rigid coaxial cable.

A further object of the present invention is to provide a connector for semi-rigid coaxial cable having integral sealing means.

A still further object of the present invention is to provide a connector for semi-rigid coaxial cable which is capable of field assembly.

A still further object of the present invention is to provide a connector for semi-rigid coaxial cable having integral retention means for controlling relative movement of connector parts.

Yet a further object of the present invention is to provide a connector for semi-rigid coaxial cable which is readily and economically produced, and readily assembled.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

FIG. 1 is an exploded perspective view of the subject connector plug prior to assembly.

FIG. 2 is a side elevation view, taken partially in section, of the subject connector plug with the coaxial cable properly positioned prior to the insertion of the grip ring into the shell body.

FIG. 3A is a side elevation view, taken partially in section, of the subject connector plug subsequent to full insertion of the grip ring into the shell body completing the termination to the coaxial cable.

FIG. 3B is a view in transverse section of the connector plug illustrated in FIG. 3A, taken along the line 3B.

FIG. 4 is a perspective view of a contact member suitable for incorporation into an alternative embodiment of the subject invention.

FIG. 5 is a side elevation taken partially in section of a connector plug alternatively embodying the principles of the subject invention.

DETAILED DESCRIPTION OF THE PREFERRED EMBODIMENT

Referring first to FIG. 1, the subject connector plug 10 for terminating semi-rigid coaxial cable is shown to comprise an elongate coupling nut 12, a tubular shell body 14, a gasket ring 16, and a grip ring 18. The subject connector plug is intended to terminate a semi-rigid coaxial cable 20, of the type comprising a center conductor 22, an intermediate dielectric layer 24, and an outer metallic solid sheath 26. The outer sheath 26 is commonly made of copper or like conductive metal. As shown, the center conductor 22 of the coaxial cable 20 is prepared to project forward a distance from the intermediate dielectric layer 24 and the metallic sheath 26 therearound. The tubular shell body 14, as illustrated in FIGS. 1 and 2, has a rearward portion 28, an annular flange 30 intermediately provided therearound, and a forward portion 32. A bore 34 extends longitudinally through the shell body 14, and a plurality of grooves 36 are provided within the interior walls of the rearward portion 28 defining the serrated bore 34. As best shown by FIG. 2, the interior of the shell body 14 is contoured forwardly from the rearward portion 28 towards the forward portion 32 as indicated by reference numeral 38. The purpose for this forward contour will be explained in greater detail below.

Continuing, the coupling nut 12 is internally threaded as indicated at 40, and further includes an inwardly projecting annular lip 42. The grip ring 18, as shown in FIG. 1, includes a solid body portion 44, multiple spline fingers 48 projecting forwardly from the periphery of the solid body portion 44, and an outwardly directed annular flange 46 at the rearward end of the solid body portion 44.

Assembly of the subject connector procedes as follows. Referring to FIG. 2, the gasket ring 16 is first assembled over and against the annular flange 30 of the shell body 14. The coupling nut 12 is positioned having the annular lip 42 in engagement against the rearward side of the shell body annular flange 30, and projects forwardly therefrom. The grip ring 18 is slideably moved forward into the rearward end of the shell body 14, and there awaits the application of the termination tooling. As illustrated in FIG. 3A, the assembly tool has two opposing members 50, 52 which move relative to each other on a common axis. With the grip ring 18, coupling nut 12, and the shell body 14 preassembled over the cable as set forth above, the forward surface of the tool member 50 locates the end of the connector shell body 14 flush with the end of the cable sheath 26. The forwardmost extending surface of the other tool member 52 then presses the grip ring 18 into the shell body 14 until the flange 46 of the grip ring bottoms. The coupling nut 12 is trapped between the grip ring flange 46 and the shell body flange 30.

With continuing reference to FIG. 3A, some general comments on the action of the grip ring 18 follow. As the spline fingers 48 enter the shell body 14, they are deflected inward by contour 38 of the shell body 14. The spline fingers 48 are forced into the softer cable sheath 26, plowing progressively deeper furrows with the forward motion. The spline fingers are sharp pointed for easy penetration and minimum distortion of the cable sheath 26. The self-splining action provides torque resistance and the tapered penetration resists tensile forces exerted upon the cable 20.

Referring to FIG. 3B, it will be appreciated that interaction between grip ring solid surface 44 and the longitudinal grooves 36 of the wall body 14 along with the interaction between grooves 44A on the inside surface of grip ring 18 and the cable sheath creates an interlocking relationship. This interlocking engagement further acts to resist any externally originating torque generated on the cable. Further, the interlocking press fit between the grooves 36 and surface 44 resists tensile forces between the grip ring 18 and the shell body 14 in the assembled state.

The subject invention is applicable to other connector configurations, such as cable jacks, and to other cable plug embodiments. One such other cable plug embodiment is illustrated in assembled transverse section by FIG. 5, and incorporates the use of a contact member 54 illustrated in FIG. 4. Referring to FIG. 4, the contact member 54 comprises a rearward crimp barrel 56, an intermediate annular latching projection 58, and a forward pin portion 60. As shown in FIG. 5, the contact member 54 is intended for engagement to the forwardly extending center conductor 22 of the semi-rigid cable 20, with the rearward crimp barrel 56 of the contact member 54 crimped to the center conductor 22 in a manner conventional to the industry. It will be further appreciated from FIG. 5 that the alternative embodiment of the subject invention includes a tubular shell body 14 having an elongated mid-portion 62. Further comprising the plug assembly shown in FIG. 5 is a dielectric insert body 64 intended for insertion into the forward end of the shell body 14, said insert 64 receiving the mid-portion of the contact member 54 therein. The annular latching projection 58 of the contact member 54 engages the dielectric insert 64 to retain the contact member therein, and a rearwardly extending shoulder 66 of the dielectric insert 64 abuts against the rearward crimp barrel portion 56 of the contact member. Assembly of the alternative plug embodiment in FIG. 5 procedes in the manner explained above for the preferred embodiment, with the grip ring 18 moved forward into the rearward portion of the shell body 14, and with the spline fingers 48 of the grip ring 18 deflected inwardly to embed into the outer metallic sheath 26 of the cable 20 and the serrated bore 34 and grooves 44A interacting respectively with grip ring 18 and the cable sheath. It will be appreciated that the contact member 54 projects through the elongate mid-portion 62 of the shell body 14 and, therein, is surrounded by free space.

While the above description of the preferred embodiment and the alternative embodiment exemplify principles of the subject invention, other embodiments which will be apparent to one skilled in the art and which utilize the teachings herein set forth are intended to be within the scope and spirit of the subject invention.

I claim:

1. An electrical connector for terminating semi-rigid coaxial cable, comprising:

a bored tubular shell member having rearward bore means of relatively large inner diameter inwardly contoured toward forward bore means having a relatively smaller inner diameter dimensioned to receive said cable therethrough;

coupling means on said tubular member;

bored gripping means having a rearward collar portion dimensioned to closely receive said cable therethrough, and having a plurality of spline fingers extending forward from the periphery of said collar portion defining therebetween a profiled opening of a dimension substantially equal said cable diameter, and grooves extending along an inside surface of said gripping means, said gripping means being rearwardly disposed of said tubular member, whereby, upon moving said gripping means forwardly into said rearward bore means, said spline fingers are resiliently deflected inwardly along said contour to embed into an outer conductive layer of said cable and said grooves engage the outer conductive layer of the cable.

2. A connector plug as set forth in claim 1, further comprising gasket means in peripheral engagement with said tubular shell member for sealing the interface of said plug.

3. A connector plug as set forth in claim 1, said tubular shell member having an outwardly directed external annular flange, and said coupling means comprising a nut having rearward flange means in engagement against said shell member flange.

4. A connector plug as set forth in claim 1, including a center contact means comprising a forward length of said cable center conductor adapted to project forward a distance free of said outer conductive layer, and free of an intermediate dielectric layer of said cable disposed between said outer layer and said inner conductor.

5. A connector plug as set forth in claim 1, said spline fingers each being tapered to a point.

6. A connector plug as set forth in claim 1, said tubular shell member having longitudinal grooves within rearward walls defining said rearward bore means, said grooves engaging said gripping means collar portion for resisting rotational motion of said gripping means within said tubular shell member.

7. A connector plug as set forth in claim 1, said gripping means having an outwardly directed annular flange at a rearward end in abutting engagement against a rearward end of said tubular shell member.

8. A connector plug as set forth in claim 1, said center contact means comprising a terminal member affixed to a forward end of said cable center conductor.

9. A connector plug as set forth in claim 8, further comprising a dielectric insert having a bore therethrough, said forward bore means receiving said insert therein with said terminal member positioned within said insert bore.

10. An electrical connector for terminating semi-rigid coaxial cable, comprising:

a bored tubular shell member having rearward bore means of relative large inner diameter inwardly contoured toward forward bore means having a relatively smaller inner diameter dimensioned to receive said cable therethough, and said shell member having longitudinally grooved wall means defining said rearward bore means;

coupling means on said tubular member;

bored gripping means having a rearward collar portion dimensioned to closely receive said cable therethrough and having an outwardly directed annular flange at a rearward end, and said gripping means having a plurality of tapered spline fingers extending forward from the periphery of said collar portion defining therebetween a profiled opening of a dimension substantially equal said cable diameter, and grooves extending along an inner surface of said gripping means, said gripping means being rearwardly disposed of said tubular member, whereby, upon moving said gripping means forwardly into said rearward bore means with said gripping means flange abutting a rearward end of said tubular member, said spline fingers are resiliently deflected inwardly along said contour to embed into an outer conductive layer of said cable, said grooved wall means engaging said gripping means collar portion and said grooves engaging the cable to resist rotational movement of said gripping means within said tubular member.

* * * * *

UNITED STATES PATENT OFFICE

CERTIFICATE OF CORRECTION

Patent No. 4,408,821 Dated October 11, 1983

Inventor(s) Edgar W. Forney, Jr.

It is certified that error appears in the above-identified patent and that said Letters Patent are hereby corrected as shown below:

Claims 2 through 9, the first line of each, after "connector", delete "plug".

Claim 2 (column 4, line 53), change "plug" to ---connector---.

Signed and Sealed this

*Twenty-seventh* Day of *March 1984*

[SEAL]

*Attest:*

GERALD J. MOSSINGHOFF

*Attesting Officer* *Commissioner of Patents and Trademarks*